US007584960B2

(12) United States Patent
Ha

(10) Patent No.: US 7,584,960 B2
(45) Date of Patent: Sep. 8, 2009

(54) REGISTRATION DEVICE AND IMAGE FORMING APPARATUS HAVING THE SAME

(75) Inventor: Dong-woo Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 159 days.

(21) Appl. No.: 11/528,625

(22) Filed: Sep. 28, 2006

(65) Prior Publication Data

US 2007/0126176 A1 Jun. 7, 2007

(30) Foreign Application Priority Data

Dec. 2, 2005 (KR) ..... 10-2005-0116894

(51) Int. Cl.
*B65H 9/04* (2006.01)

(52) U.S. Cl. ..... 271/246; 271/245; 271/243; 271/244; 271/253

(58) Field of Classification Search ..... 271/226, 271/243–246, 235, 236, 253
See application file for complete search history.

(56) References Cited

U.S. PATENT DOCUMENTS 4,223,886 A * 9/1980 Vogt ..... 271/246
4,750,853 A * 6/1988 Van Soest et al. ..... 414/789.9
5,074,545 A * 12/1991 Handa ..... 271/227
6,011,948 A * 1/2000 Amano et al. ..... 399/395
6,234,470 B1 * 5/2001 Okitsu et al. ..... 271/114
6,651,972 B2 * 11/2003 Hsiao et al. ..... 271/114
7,308,227 B2 * 12/2007 Ahn ..... 399/388

FOREIGN PATENT DOCUMENTS

JP 64-087453 3/1989
JP 06-100208 4/1994
KR 10-2005-0087262 8/2005

OTHER PUBLICATIONS

Chinese Office Action dated Mar. 20, 2009 issued in CN 200610163770.3.

* cited by examiner

*Primary Examiner*—Patrick H Mackey
*Assistant Examiner*—Luis Gonzalez
(74) *Attorney, Agent, or Firm*—Stanzione & Kim LLP

(57) ABSTRACT

A registration device usable with an image forming apparatus includes a registration roller, a registration lever to rotate between an alignment position to block and align a leading edge of a paper sheet supplied to the registration roller and an opening position to allow the paper sheet to be fed beyond the registration lever, and a resilient member to resiliently urge the registration lever to rotate into the alignment position. The resilient member has a center portion and first and second arms extending from the center portion. An end of the first arm is coupled to the registration lever and the resilient member is pivotable about an end of the second arm.

14 Claims, 9 Drawing Sheets

REGISTRATION DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 10-2005-0116894, filed on Dec. 2, 2005, in the Korean Intellectual Property Office, the disclosure of which is incorporated herein in its entirety by reference.

BACKGROUND OF THE INVENTION

1. Field of the Invention

The present general inventive concept relates to a registration device to align a leading edge of a paper sheet and an image forming apparatus having the registration device.

2. Description of the Related Art

FIG. 1 is a view illustrating a conventional paper sheet registration method. Referring to FIG. 1, a paper sheet P is picked up from a cassette 5 by a pickup roller 1 and supplied to a registration roller 3. The registration roller 3 conveys the paper sheet P according to a printing speed of a printing element 4. Paper skew may take place in the process of conveying the paper sheet P from the cassette 5 to the registration roller 3. Accordingly, to obtain a printed image with high quality, a registration process is performed to correct the paper skew.

A conventional registration method will now be briefly described with reference to FIG. 1. When the paper sheet P is conveyed to the registration roller 3, the registration roller 3 is rotated in a reverse direction, i.e., a direction opposite to a direction in which the paper sheet P is fed. Thus, when a leading edge of the paper sheet P reaches the registration roller 3, the paper sheet P is prevented from moving further toward the printing element 4. If the pickup roller 1 continues to rotate, the paper sheet P is curled as illustrated by a broken line D in FIG. 1. As a result, the leading edge of the paper sheet P is aligned with respect to the registration roller 3. Subsequently, the registration roller 3 is rotated in a forward direction, to make the paper sheet P move toward the printing element 4.

This method of aligning a paper sheet through the reverse and forward rotation of the registration roller is problematic in the following aspects. First of all, the leading edge of the paper sheet may be damaged when the registration roller rotates in a reverse direction, thereby increasing the likelihood of a paper jam. Second, the registration roller must be stopped during the reverse rotation and then rotated in a forward direction, which is quite difficult due to an inertial resistance of the registration roller. Thus, a motor (not shown) that drives the registration roller may be overloaded. In a case of a high-speed printing image forming apparatus, it is even more difficult to change the rotational direction of the registration roller. Accordingly, it has been proposed to gently reduce the speed of the registration roller in order to stop the reverse rotation, and then to forwardly rotate the registration roller at a gradually increasing speed. However, such deceleration and acceleration process is time-consuming, and therefore reduces the printing speed of the image forming apparatus. Third, a power coupling device of a complicated structure has to be employed in order to rotate the registration roller in both the reverse and forward directions, which increases manufacturing costs of the image forming apparatus.

In addition, an alternate method may be used, wherein the registration roller is stopped temporarily to align the leading edge of the paper sheet, after which the registration roller is rotated forward to convey the paper sheet. However, this method also requires the use of a complicated power coupling device and increase manufacturing costs of the image forming apparatus.

SUMMARY OF THE INVENTION

The present general inventive concept provides a registration device suitable to a high-speed printing operation and an image forming apparatus having the registration device.

The present general inventive concept also provides a registration device with a low cost and simple structure, and an image forming apparatus having the registration device.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a registration device including a registration roller, a registration lever able to rotate between an alignment position to block and align a leading edge of a paper sheet supplied to the registration roller and an opening position to allow the paper sheet to be fed beyond the registration lever, and a resilient member to resiliently urge the registration lever to rotate into the alignment position, the resilient member having a center portion and first and second arms extending from the center portion, wherein an end of the first arm is coupled to the registration lever and the resilient member is pivotable about an end of the second arm.

The foregoing and/or other aspects of the present general inventive concept may also be achieved by providing an image forming apparatus including a printing element to form an image on a paper sheet, and a registration device to align a leading edge of the paper sheet supplied to the printing element, the registration device including a registration roller, a registration lever able to rotate between an alignment position to block and align a leading edge of a paper sheet supplied to the registration roller and an opening position to allow the paper sheet to be fed beyond the registration lever, and a resilient member to resiliently urge the registration lever to rotate into the alignment position, the resilient member having a center portion and first and second arms extending from the center portion, wherein an end of the first arm is coupled to the registration lever and the resilient member is pivotable about an end of the second arm.

The registration roller may be disposed on an inlet side of the printing element and feed the paper sheet at a predetermined printing speed.

The registration roller may be positioned between a pickup roller and a feed roller.

The registration lever may be rotatably attached to the registration roller.

When the registration lever is in the opening position, a line joining a center of the registration roller and the end of the first arm may not exceed a line joining the center of the registration roller and the end of the second in a clockwise direction of the center of the registration roller. An angle formed by the line joining the center of the registration roller and the end of the first arm and the line joining the center of the registration roller and the end of the second arm may be greater than 3 degrees. A restriction member may be provided to restrict the registration lever from rotating beyond a position where the opening angle is equal to or greater than 3 degrees when the registration lever rotates to the opening position. The registration lever may comprise a registration portion to block the leading edge of the paper sheet and a guide portion to guide a movement of the paper sheet when the registration lever is in the opening position. The guide portion may protrude from the center of the registration roller farther than the registration portion and may have an end of round shape.

The foregoing and/or other aspects of the present general inventive concept may also be achieved by providing a registration device usable in an image forming apparatus, including a registration roller rotable with a shaft to feed a printing paper along a path, a registration lever disposed around the shaft to move between an alignment position disposed in the path, and an open position disposed apart from the path, and a resilient member to apply a first force to the registration lever to be in the alignment position and to apply a second force to the registration lever to move from the open position to the alignment position.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
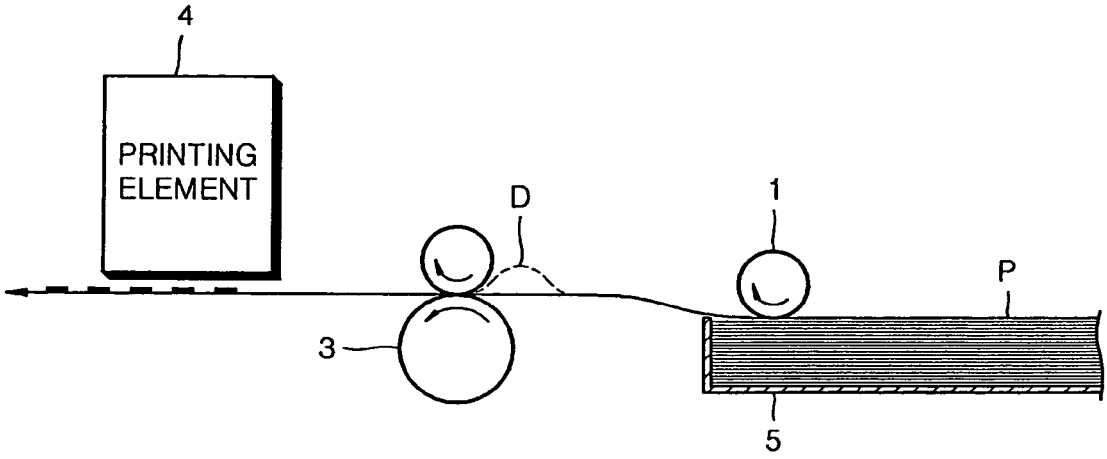
FIG. 1 (PRIOR ART)
FIG. 1 is a view illustrating a conventional paper sheet registration method.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
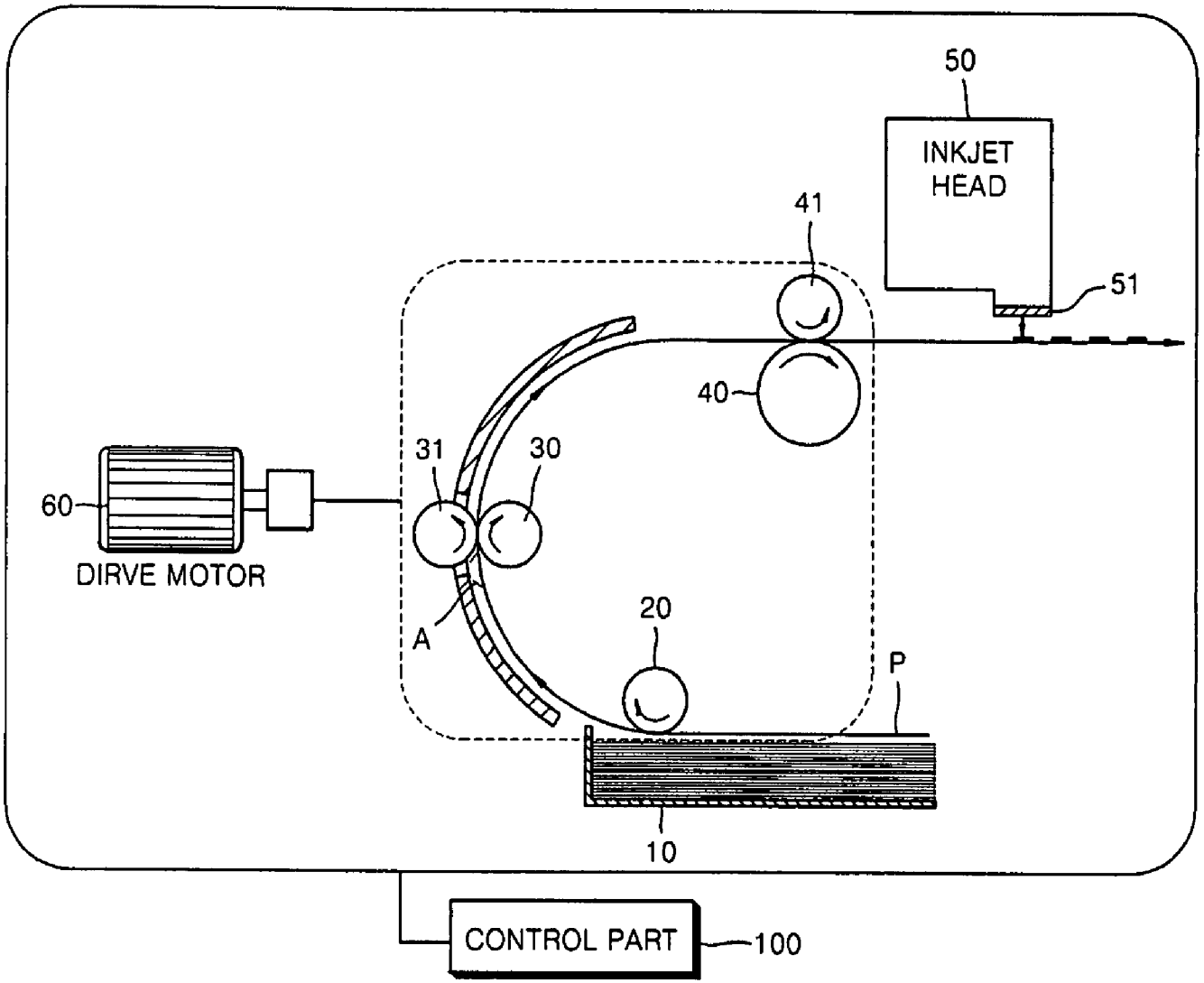
FIG. 2 is a schematic view illustrating an image forming apparatus according to an embodiment of the present general inventive concept.

FIG. 2 is a schematic view illustrating an image forming apparatus according to an embodiment of the present general inventive concept.

Referring to FIG. 2, the image forming apparatus includes a cassette 10 wherein printing media, such as paper sheets P are stacked, a pickup roller 20 to pick up the paper sheets P one by one, and a feed roller 40 and a driven roller 41 that are pressed against each other and rotated to feed the paper sheet P at a predetermined speed. The image forming apparatus may further include a drive roller 30 and an idle roller 31 provided between the pickup roller 20 and the feed roller 40 to assist a feeding process of the paper sheet P. A plurality of pairs of the drive roller 30 and the idle roller 31 may be used. A drive motor 60 is employed to rotate the pickup roller 20, the drive roller 30, and the feed roller 40. Reference numeral 50 is an exemplary printing element that prints images on the paper sheet P. In the embodiment of FIG. 2, the printing element 50 is a shuttle-type inkjet head that reciprocates in a direction perpendicular to the feeding direction of the paper sheet P and ejects ink droplets on the paper sheet P through a nozzle portion 51 to thereby print an image. Alternatively, it is possible to employ an array-type ink jet head as the printing element 50, which has a nozzle portion whose length corresponds to a width of the paper sheet P. An electrophotographic printing unit may also be used to print an image on the paper sheet P by an electrophotography method. A variety of other printing element may be used to print an image on the moving paper sheet P.

The paper sheet P should be aligned, i.e., registered, prior to reaching the ink jet head 50. Thus, the image forming apparatus may include a registration device. For example, the drive roller 30 or the feed roller 40 may be used as a registration roller to align or register the paper sheet P. In the present embodiment, the drive roller 30 is used as the registration roller, and therefore, the drive roller 30 will be referred to as the registration roller 30 in the following description.

Figure 3:
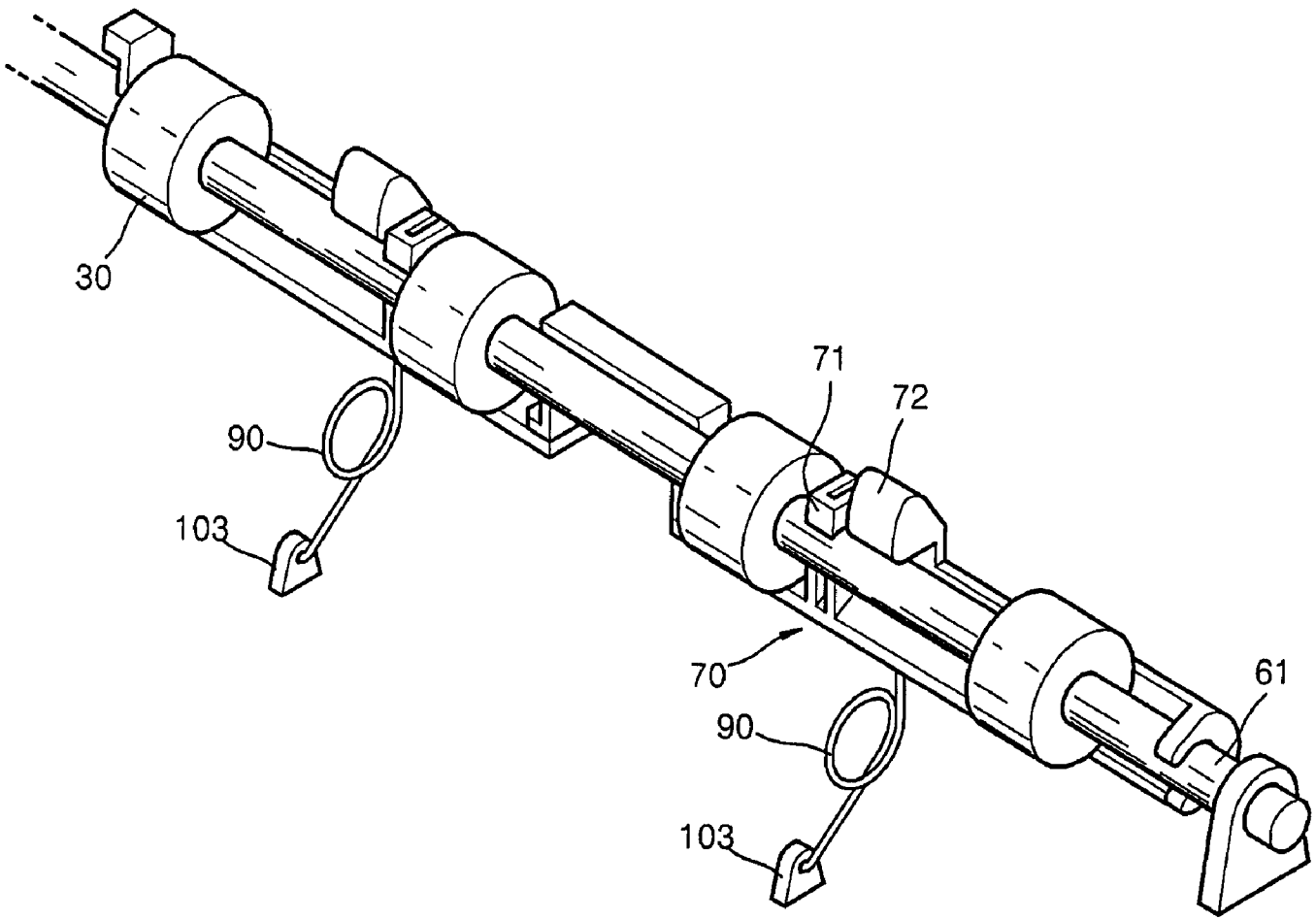
FIG. 3 is a perspective view illustrating a registration device employed in the image forming apparatus of FIG. 2, according to an embodiment of the present general inventive concept.
Figure 4:
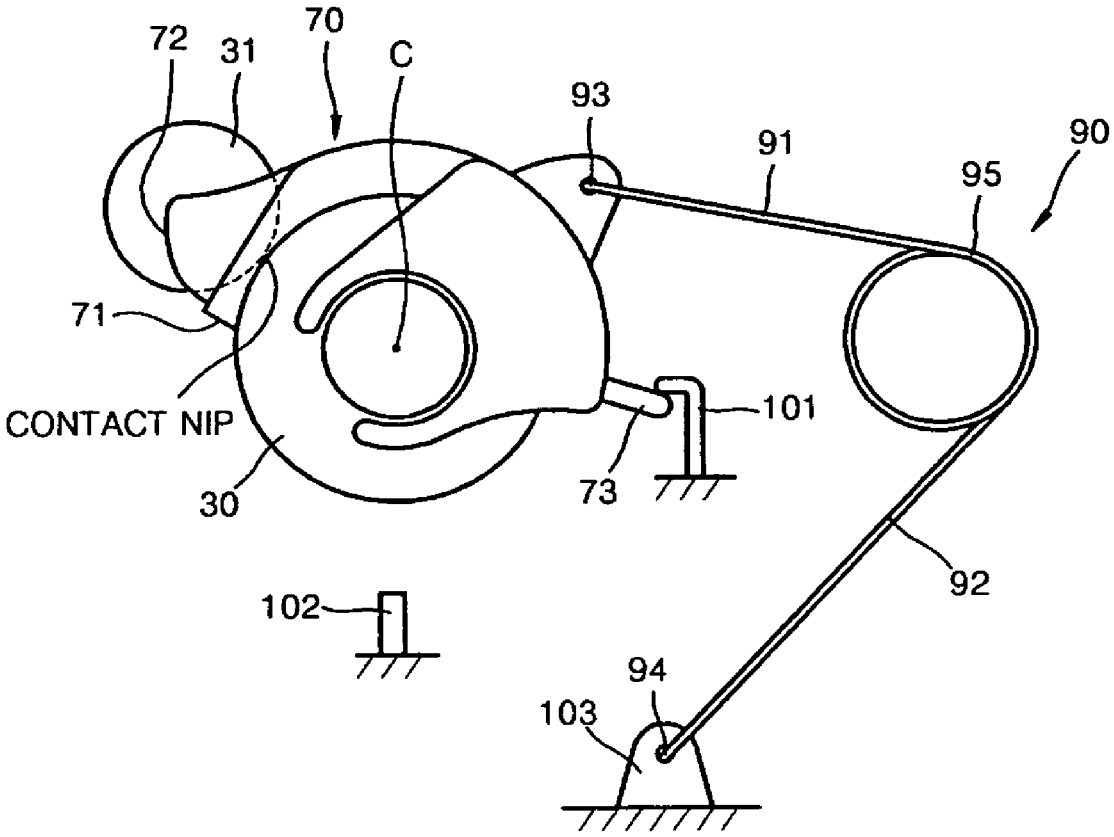
FIG. 4 is a side view illustrating the registration device of FIG. 3.
Figure 7:
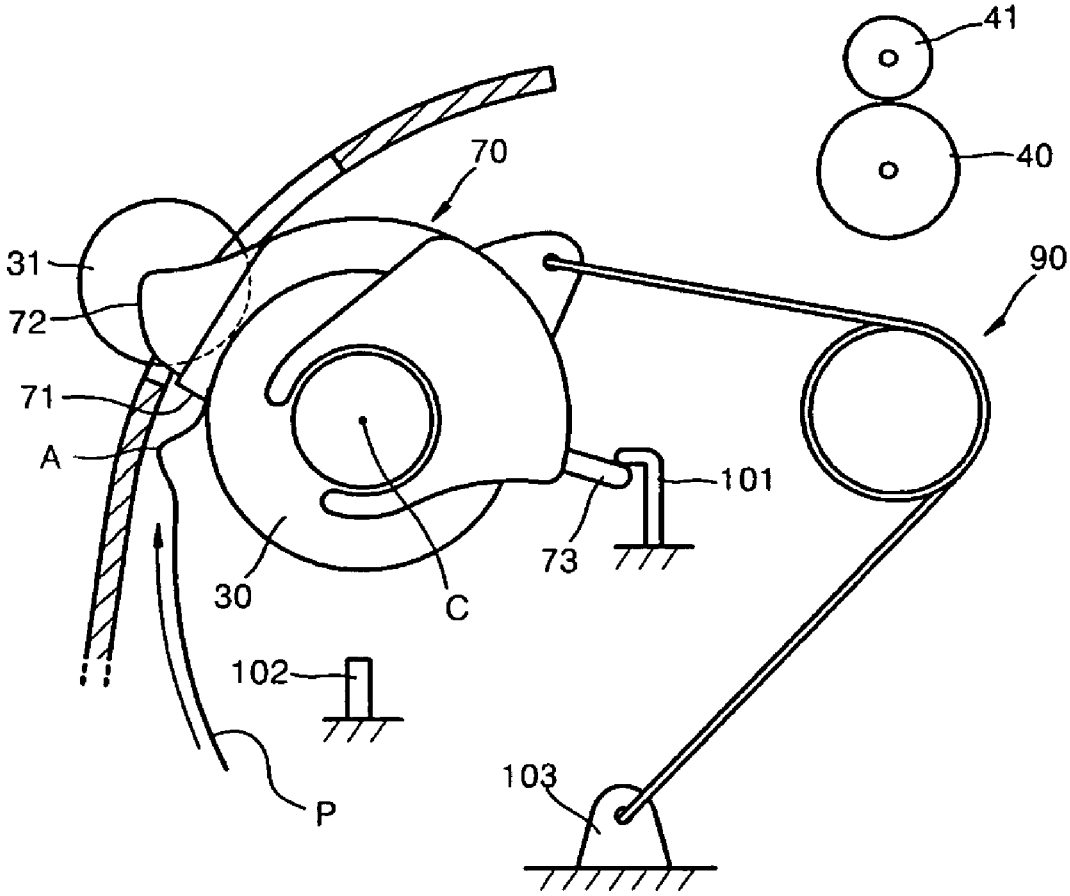
FIG. 7 is a view illustrating the registration lever of the registration device of FIG. 3 placed in an alignment position.
Figure 8:
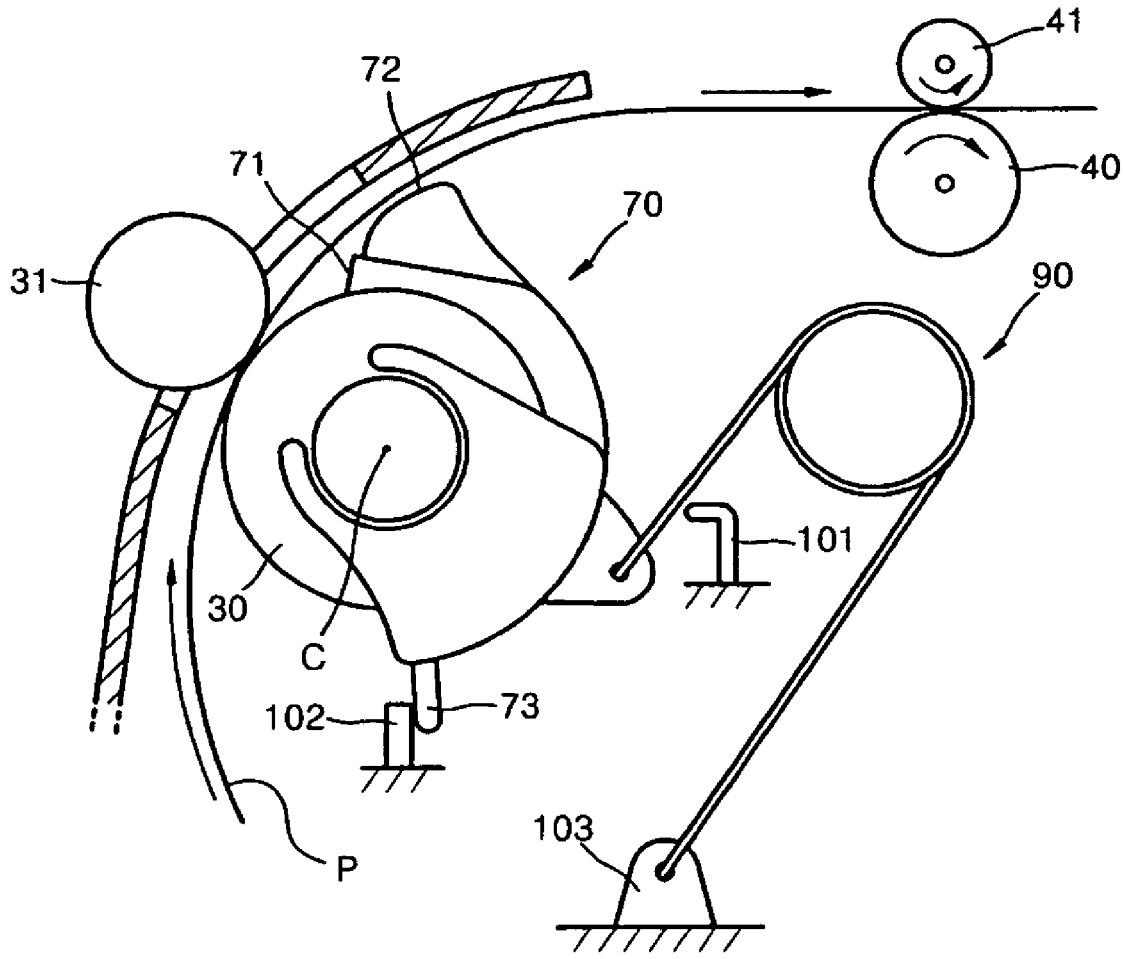
FIG. 8 is a view illustrating the registration lever of the registration device of FIG. 3 placed in an opening position.

FIG. 3 is a perspective view illustrating the registration device used in the image forming apparatus of FIG. 2, according to an embodiment of the present general inventive concept, and FIG. 4 is a side view illustrating the registration device shown in FIG. 3. Referring to FIGS. 3 and 4, the registration device includes the registration roller 30 disposed on a shaft 61, a registration lever 70 to rotate between an alignment position (as illustrated in FIGS. 4 and 7) to block and align a leading edge of the paper sheet P and an opening position (as illustrated in FIG. 8) to allow the paper sheet P to be fed beyond the registration lever 70, and a resilient member 90 to resiliently urge the registration lever 70 to rotate into the alignment position.

The registration lever 70 may be rotatably attached to the registration roller 30 and has a registration portion 71 and a guide portion 72. The registration lever 70 may also be disposed around the shaft 61 and/or disposed between a pair of registration rollers 30. The registration portion 71 is positioned on an inlet side of the registration roller 30 so as to contact the leading edge of the paper sheet P supplied to the registration roller 30. As used herein, the inlet side of the registration roller 30 denotes an area before a contact nip formed between the registration roller 30 and the idle roller 31. The guide portion 72 guides a movement of the paper sheet P when the registration lever 70 is in the opening position. The guide portion 72 protrudes from a center C of the registration roller 30 farther than the registration portion 71 and may have a leading end having a round shape. The resilient member 90 has a center portion 95 and first and second arms 91 and 92, respectively extending from the center portion 95. An end 93 of the first arm 91 is coupled to the registration lever 70, whereas an end 94 of the second arm 92 serves as a center of rotation around which the resilient member 90 pivots. Thus, in the present embodiment, the end 94 of the second arm 92 is coupled to a mounting bracket (reference surface) 103 of the image forming apparatus.

Figure 5:
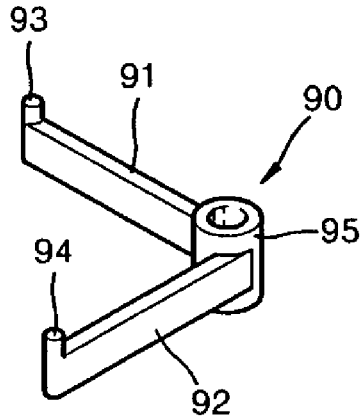
FIGS. 5 and 6 are perspective views illustrating examples of a resilient member used in the registration device of FIG. 3, according to an embodiment of the present general inventive concept.
Figure 6:
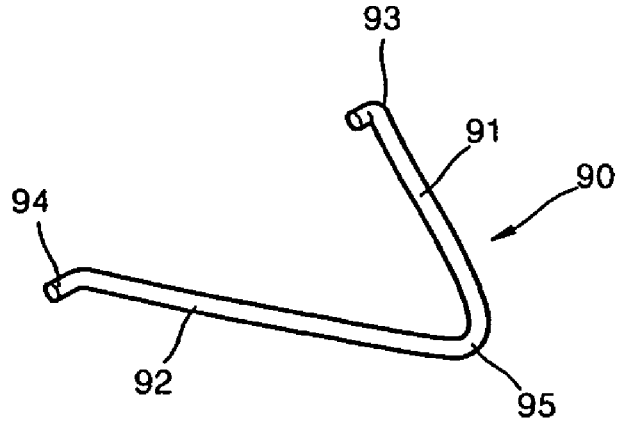

Although a torsion spring is employed as an example of the resilient member 90 in the present embodiment, it should be appreciated that the resilient member 90 is not limited to a torsion spring but may be other types of resilient members that have a center part, a first arm and a second arm. For example, the resilient member 90 may be molded of plastics as illustrated in FIG. 5 or may be a linear spring as illustrated in FIG. 6. The registration lever 70 may further include a projection arm 73, such that, when the projection arm 73 contacts a stopper 101, the registration lever 70 is placed in the alignment position.

Figure 9A:
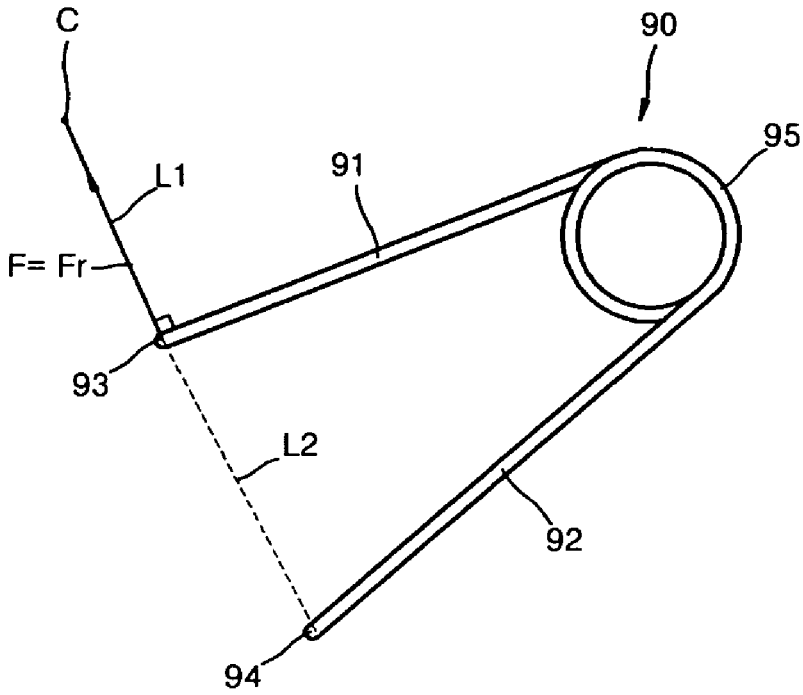
FIGS. 9A, 9B and 9C are views illustrating an acute angle formed in the registration device of FIG. 3.
Figure 9B:
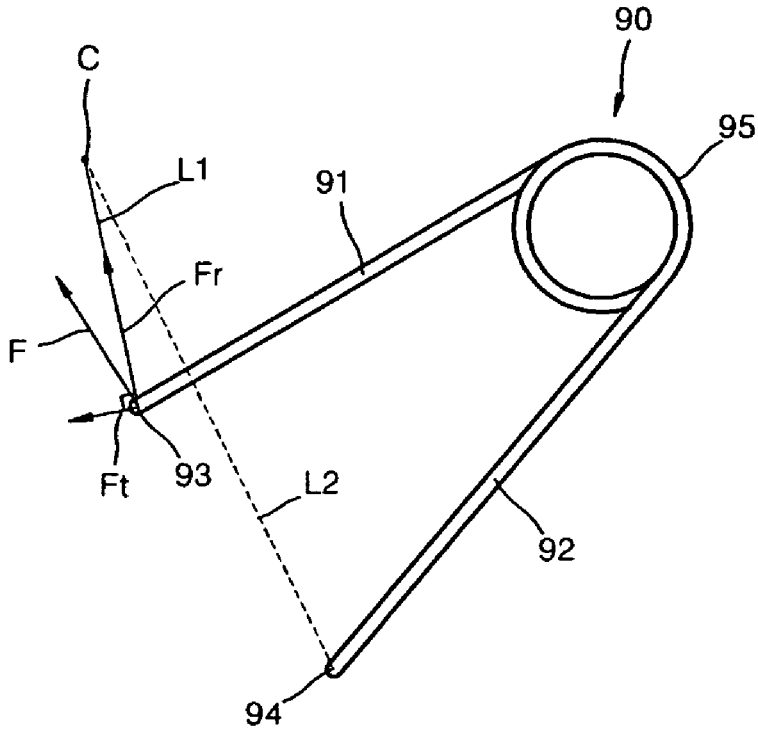

The opening position of the registration lever 70 may be changed depending on a stiffness of the paper sheet P. When the registration lever 70 is in the opening position, it is desirable that a line L1 linking the center C of the registration roller 30 with the end 93 of the first arm 91 do not coincide with a line L2 joining the center C of the registration roller 30 with the end 94 of the second arm 92, as illustrated in FIG. 9A. Additionally, line L1 should not be located over the line L2, I.e. L1 should not lie on a clockwise side of L2, as illustrated in FIG. 9B. The resilient force F of the first arm 91 has a radial component Fr and a tangential component Ft, the latter of which rotates the registration lever 70. Accordingly, under the conditions illustrated in FIG. 9B, the tangential component Ft acts clockwise with respect to the center C of the registration roller 30, i.e., in a direction opposite to the alignment position, thus impeding the registration lever 70 from returning back into the alignment position. Furthermore, under the condition illustrated in FIG. 9A where the line L1 coincides with the line L2 and makes a right angle with the first arm 92, the tangential component Ft of the resilient force F of the first arm 91 becomes zero, which increases the possibility that the registration lever 70 will fail to return back to the alignment position.

Figure 9C:
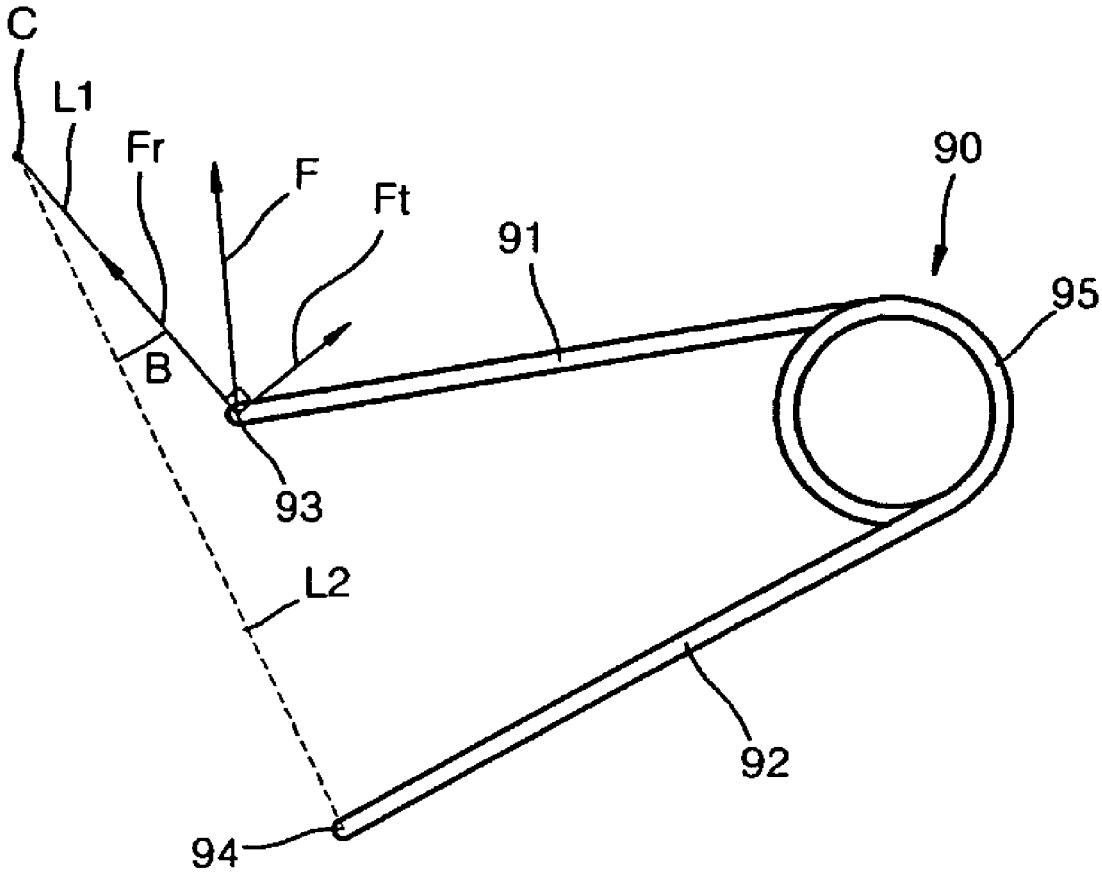

To allow the registration lever 70 to return back to the alignment position when the paper sheet P has moved past the guide portion 72, the tangential component Ft of the resilient force F of the first arm 91 must be oriented counterclockwise with respect to the center C of the registration roller 30, i.e., in a direction of the alignment position. This becomes possible by making the line L1 lie on a counterclockwise side of the line L2 as illustrated by FIG. 9C. It has been experimentally confirmed that, in order to make the tangential component Ft of the resilient force F of the first arm 91 act in the direction in which the registration lever 70 is constantly urged to return back to the alignment position, the line L1 should lie on a counterclockwise side of the line L2 and should make an acute angle B of at least 3 degrees with respect to the line L2, as illustrated in FIG. 9C.

A restriction member 102 that contacts the projection arm 73 may further used to restrict the registration lever 70 from rotating beyond a position where the acute angle B is equal to or greater than 3 degrees. As the paper sheet P moves past the guide portion 72, the registration lever 70 is rotated toward the alignment position by the resilient force F of the resilient member 90 and stops in the alignment position when the projection arm 73 contacts the stopper 101 as illustrated in FIG. 7.

A process of aligning the paper sheet P using the registration device is as follows.

Figure 10:
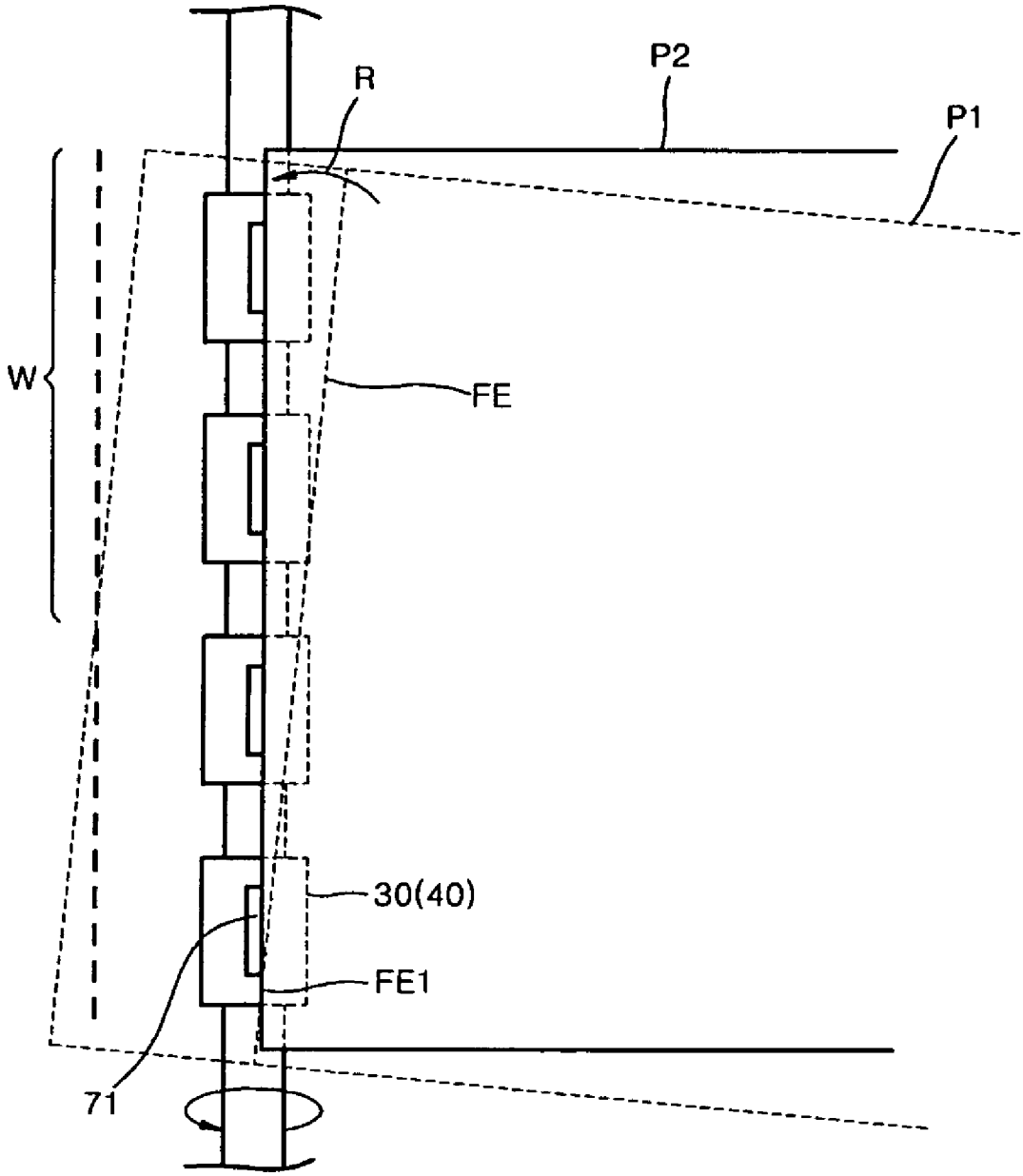
FIG. 10 is a view illustrating a process of aligning a paper sheet in an image forming apparatus according to an embodiment of the present general inventive concept.

The drive motor 60 begins to rotate when a printing command is inputted to a control part 100 of FIG. 2 by, e.g., a host computer not shown in the drawings. Accordingly, the pickup roller 20, the registration roller 30, and the feed roller 40 are rotated in a direction such that the paper sheet P is fed toward the inkjet head 50 as illustrated in FIG. 2. The paper sheet P is picked up from the cassette 10 by the pickup roller 20. As illustrated in FIG. 7, the registration lever 70 is initially kept in the alignment position to block the leading edge of the paper sheet P. The paper sheet P may be skewed when is picked up from the cassette 10 by the pickup roller 20 and fed to the registration roller 30. Thus, a side portion FE1 of the leading edge FE of the paper sheet P contacts the registration roller 30 as indicated by a dotted line P1 in FIG. 10. A paper jam may occur if the paper sheet P is further moved toward the inkjet head 50 by the feed roller 40 in this skewed state. Even if no paper jam occurs and image printing is performed, some amount W of ink ejected from the inkjet head 50 will land outside the paper sheet P, thereby decreasing printing quality.

To align or register the paper sheet P moving with a skew, the registration portion 71 blocks the paper sheet P before the leading edge FE thereof enters the contact nip formed between the registration roller 30 and the idle roller 31. At this time, the tangential component Ft of the resilient force F applied to the registration lever 70 by the resilient member 90 may be in a range of 70~120gf. If the tangential component Ft is smaller than a lower limit of the range, the registration lever 70 may be prematurely rotated into the opening position prior to finishing the alignment of the paper sheet P because a force from the paper sheet P can be greater than the tangential component Ft. In the event that the tangential component Ft is greater than an upper limit of the range, damage may be caused to the leading edge of the paper sheet P. The continued rotation of the pickup roller 20 causes the side portion FE1 of the leading edge FE of the skewed paper sheet P to be pressed against the registration portion 71. The registration lever 70 is not rotated in this state (non-flexing state) because the pressing force of the paper sheet P exerted on the registration lever 70 is insufficient to overcome the resilient force F. The side portion FE1 of the leading edge FE of the paper sheet P that has reached a portion of the registration portion 71 is slightly flexed as indicated by reference character "A" (flexing state) in FIGS. 2 and 7, while the other side portion of the leading edge FE continues to move forward until it contacts another portion of the registration portion 71. This makes sure that the paper sheet P turns around the side portion FE1 of the leading edge FE as indicated by an arrow "R" in FIG. 10. Through this process, the paper sheet P is aligned with the registration portion 71 as illustrated by a solid line P2 in FIG. 10. As the pickup roller 20 continues to rotate, the leading edge FE of the paper sheet P pushes the registration lever 70 into the opening position as shown in FIG. 8. The paper sheet P is then moved by the registration roller 30 and the idle roller 31, and thus the paper sheet P is moved past the registration portion 71 and contacts the guide portion 72. According to a width of the paper sheet P, a plurality of registration levers 70 and registration parts 71 may be used. At least two registration parts 71 are needed to align the paper sheet P. A relatively high contact noise is generated if the paper sheet P continuously contacts the registration portion 71 while moving. According to the registration device of the present embodiment, the contact noise of the paper sheet P can be reduced because, at the termination of the alignment process, the paper sheet P does not contact the registration portion 71 and is fed along the guide portion 72. A smaller number of the guide portions 72 than that of the registration portions 71 may be used. The contact noise can be further reduced by making the distal end of the guide portion 72 into a round shape. The paper sheet P is guided by the guide portion 72 and enters between the feed roller 40 and the driven roller 41. The feed roller 40 feeds the paper sheet P at a predetermined printing speed and the inkjet head 50 ejects ink on the paper sheet P. When the trailing edge of the paper sheet P has moved past the guide portion 72, the registration lever 70 is returned back to the initial alignment position by the resilient force F of the resilient member 90, as illustrated in FIG. 7.

As set forth in the foregoing, according to the registration device and the image forming apparatus using the same, the registration roller 30 is rotated only in a paper feeding or forward direction without having to rotate in forward and reverse directions to perform a conventional registration process. Thus, the structure of a power coupling mechanism (not shown) that delivers rotational power from the drive motor 60 to the registration roller 30 may be simplified. Furthermore, the possibility of damaging the leading edge FE of the paper sheet P is reduced unlike the case of a conventional device in which a registration roller has to be rotated in reverse. Thus, the image forming apparatus can be operated at an increased speed and can perform the paper registration process with ease even when the paper sheet P is fed at a higher rate of speed.

Although in the foregoing embodiment the drive roller 30 is employed as a registration roller, this should not limit the scope of the present general inventive concept. Alternatively, the feed roller 40 may be used as the registration roller, in which case the registration lever 70 has to be rotatably attached to the feed roller 40.

As apparent from the foregoing, the registration device and the image forming apparatus having the same in accordance with the present general inventive concept have the following advantages.

First of all, the structure of a power coupling device to drive a registration roller is simplified because there is no need to rotate the registration roller in forward and reverse directions to perform the registration process.

Second, since no change in the direction of rotation of a registration roller occurs throughout the entire paper feeding processes, including an alignment process, it is possible to reduce the possibility of damaging the leading edge of a paper sheet and increase the operating speed of the image forming apparatus, thereby ensuring that a paper registration process is performed with ease even when the paper sheet is fed at a higher rate of speed.

Third, noise is reduced by using a paper guide part.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A registration device comprising:

a registration roller;

a registration lever to move between an alignment position to block and align a leading edge of a paper sheet supplied to the registration roller and an opening position to allow the paper sheet to be fed beyond the registration lever, the registration lever being rotatably mounted to the registration roller; and a resilient member to resiliently urge the registration lever to rotate into the alignment position, the resilient member having a center portion disposed outside the registration roller in a radial direction thereof, and first and second arms extending from the center portion, wherein an end of the first arm is coupled to the registration lever and the resilient member is pivotable about an end of the second arm.

2. The registration device of claim 1, wherein, when the registration lever is in the opening position, a line joining a center of the registration roller and the end of the first arm does not exceed a line joining the center of the registration roller and the end of the second arm in a clockwise direction the center of the registration roller.

3. The registration device of claim 2, wherein an angle formed by the line joining the center of the registration roller and the end of the first arm and the line joining the center of the registration roller and the end of the second arm is equal to or greater than 3 degrees.

4. The registration device of claim 3, further comprising:

a restriction member to restrict the registration lever from rotating beyond a position where the angle is equal to or greater than 3 degrees when the registration lever rotates to the opening position.

5. The registration device of claim 1, wherein the registration lever comprises a registration portion to block the leading edge of the paper sheet and a guide portion to guide a movement of the paper sheet when the registration lever is in the opening position.

6. The registration device of claim 5, wherein the guide portion protrudes from a center of the registration roller farther than the registration portion and has a round shape.

7. An image forming apparatus comprising:

a printing element to form an image on a paper sheet; and a registration device to align a leading edge of the paper sheet supplied to the printing element, the registration device comprising:

a registration roller;

a registration lever able to rotate between an alignment position to block and align a leading edge of the paper sheet supplied to the registration roller and an opening position to allow the paper sheet to be fed beyond the registration lever, the registration lever being rotatably attached to the registration roller; and a resilient member to resiliently urge the registration lever to rotate into the alignment position, the resilient member having a center portion disposed outside the registration roller in a radial direction thereof, and first and second arms extending from the center portion, wherein an end of the first arm is coupled to the registration lever and the resilient member is pivotable about an end of the second arm.

8. The image forming apparatus of claim 7, wherein the registration roller is disposed on an inlet side of the printing element and feeds the paper sheet at a predetermined printing speed.

9. The image forming apparatus of claim 7, further comprising:

a pickup roller to pick up the paper sheet contained in a stacking element; and a feed roller disposed on an inlet side of the printing element to feed the paper sheet at a predetermined printing speed, wherein the registration roller is positioned between the pickup roller and the feed roller.

10. The image forming apparatus of claim 7, wherein, when the registration lever is in the opening position, a line joining a center of the registration roller and the end of the first arm does not exceed a line joining the center of the registration roller and the end of the second arm in a clockwise direction of the center of the registration rolled.

11. The image forming apparatus of claim 10, wherein an angle formed by the line joining the center of the registration roller and the end of the first arm and the line joining the center of the registration roller and the end of the second arm is equal to or greater than 3 degrees.

12. The image forming apparatus of claim 11, further comprising:

a restriction member to restrict the registration lever from rotating beyond a position where the angle is equal to or greater than 3 degrees when the registration lever rotates to the opening position.

13. The image forming apparatus of claim 12, wherein the registration lever comprises a registration portion to block the leading edge of the paper sheet and a guide portion to guide a movement of the paper sheet when the registration lever is in the opening position.

14. The image forming apparatus of claim 13, wherein the guide portion protrudes from a center of the registration roller farther than the registration portion and has a round shape.

* * * * *